US009133574B2

(12) United States Patent
Kim et al.

(10) Patent No.: US 9,133,574 B2
(45) Date of Patent: Sep. 15, 2015

(54) WASHING MACHINE

(75) Inventors: Young Suk Kim, Seoul (KR); Sang Wook Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 164 days.

(21) Appl. No.: 13/994,539

(22) PCT Filed: Dec. 16, 2011

(86) PCT No.: PCT/KR2011/009730

§ 371 (c)(1), (2), (4) Date: Dec. 2, 2013

(87) PCT Pub. No.: WO2012/081935

PCT Pub. Date: Jun. 21, 2012

(65) Prior Publication Data

US 2014/0076002 A1 Mar. 20, 2014

(30) Foreign Application Priority Data

Dec. 16, 2010 (KR) ..... 10-2010-0128831

(51) Int. Cl.

| | |
|---|---|
| ***D06F 29/00*** | (2006.01) |
| ***D06F 17/04*** | (2006.01) |
| *D06F 18/00* | (2006.01) |
| *D06F 39/04* | (2006.01) |
| *D06F 39/08* | (2006.01) |

(52) U.S. Cl.

CPC ..... *D06F 17/04* (2013.01); *D06F 39/088* (2013.01); *D06F 18/00* (2013.01); *D06F 39/04* (2013.01); *D06F 39/08* (2013.01)

(58) Field of Classification Search

CPC ..... D06F 58/10; D06F 58/203; D06F 73/02; D06F 58/20; B60S 3/04

USPC ..... 134/172, 179, 180, 169 R, 18, 34, 103.2; 68/20, 5 C, 222, 12.08, 205 R, 264, 5 R; 34/202, 218, 201, 72, 130, 621, 229, 34/232, 239

See application file for complete search history.

(56) References Cited

U.S. PATENT DOCUMENTS

| | | | | |
|---|---|---|---|---|
| 7,235,109 | B2 * | 6/2007 | Kleker | 8/149.3 |
| 2005/0235518 | A1 * | 10/2005 | Binder | 34/202 |
| 2006/0157583 | A1 * | 7/2006 | Huang | 239/242 |

FOREIGN PATENT DOCUMENTS

| | | | |
|---|---|---|---|
| KR | 20-1999-0002574 | U | 1/1999 |
| KR | 10-2003-0009694 | A | 2/2003 |

* cited by examiner

*Primary Examiner* — Michael Barr
*Assistant Examiner* — Thomas Bucci
(74) *Attorney, Agent, or Firm* — Dentons US LLP

(57) ABSTRACT

There is disclosed a washing machine including a spouting module with a variable spouting direction. The washing machine includes a cabinet forming an external appearance, an accommodating module arranged in the cabinet and including an accommodating case in which a space for accommodating laundry is formed, spouting units formed in a horizontal direction and arranged in the accommodating case to spout water, and a driving unit for having the spouting units perform reciprocating rotational motions.

10 Claims, 15 Drawing Sheets

WASHING MACHINE

This application is a 35 USC §371 National Stage entry of International Application No. PCT/KR2011/009730 filed Dec. 16, 2011, and claims priority of Korean Application No. 10-2010-0128831 filed Dec. 16, 2010, which is hereby incorporated by reference in its entirety.

TECHNICAL FIELD

The present invention relates to a washing machine, and more particularly, to a washing machine including a spouting module with a variable spouting direction.

BACKGROUND ART

In general, a washing machine refers to various apparatuses for applying physical and chemical operations to laundry to process the laundry such as a washer for separating contaminants from clothes, bedding, etc. (hereinafter, referred to as 'laundry') using a chemical decomposition of water and detergent and a physical operation such as friction between water and laundry, a drier for dewatering wet laundry to dry the dewatered laundry, and a refresher for spouting heated steam to prevent allergy from being caused by laundry and conveniently washing laundry.

On the other hand, in a washing machine having a multi-function so that washing and drying may be performed together, water supply spouting nozzles for supplying water and hot air spouting nozzles for supplying hot air are provided.

In the washing machine, it is very important in washing laundry that the laundry is evenly wetted by water. Therefore, it is necessary for the water supply spouting nozzles to be efficiently operated.

DISCLOSURE

Technical Problem

An object of the present invention is to provide a washing machine, in which a spouting module includes a driving unit so that the spouting module is variably driven and laundry is effectively washed.

Another object of the present invention is to provide a washing machine, in which a spouting module performs a reciprocating rotational motion with a predetermined central angle about a predetermined shaft so that water is evenly distributed to laundry with a minimum necessary operating range and space usage is improved.

Still another object of the present invention is to provide a washing machine, in which a driving unit of a spouting module includes a power transmitting unit so that the spouting module is driven and controlled by the driving unit.

Still another object of the present invention is to provide a washing machine, in which hot air spouting guide units are provided so that hot air provided to an accommodating case is evenly spouted in the accommodating case in a uniform direction and laundry is effectively dried.

Still another object of the present invention is to provide a washing machine, in which a water supply pipe including a branch unit that forms a Y-shaped flow channel is provided so that water is efficiently distributed.

Still another object of the present invention is to provide a washing machine, in which a spouting module includes hot air spouting nozzles so that water supply spouting nozzles and the hot air spouting nozzles are integrated with each other and the water supply spouting nozzles and the hot air spouting nozzles are integrally driven.

Technical Solution

In order to achieve the above objects, there is provided a washing machine including a cabinet forming an external appearance, an accommodating module arranged in the cabinet and including an accommodating case in which a space for accommodating laundry is formed, spouting units formed in a horizontal direction and arranged in the accommodating case to spout water, and a driving unit for having the spouting units perform reciprocating rotational motions.

Advantageous Effects

In a washing machine according to the present invention, a spouting module is variably driven so that water is evenly spouted to laundry and the laundry may be effectively washed.

In a washing machine according to the present invention, a spouting module includes spouting units that perform reciprocating rotational motions with predetermined central angles about predetermined shafts so that water is evenly spouted to laundry with a minimum necessary operating range and a space may be effectively used.

In a washing machine according to the present invention, an entire spouting module is driven and controlled by one driving unit so that water may be evenly spouted by a simple mechanism.

In a washing machine according to the present invention, hot air is evenly spouted to an accommodating case through hot air spouting guide units so that laundry may be efficiently dried.

In a washing machine according to the present invention, a water supply pipe including a branch unit that forms a Y-shaped flow channel is provided so that water may be efficiently distributed.

In a washing machine according to the present invention, a spouting module includes hot air spouting nozzles so that water supply spouting nozzles and the hot air spouting nozzles may be integrated with each other and the water supply spouting nozzles and the hot air spouting nozzles may be integrally driven.

MODE FOR INVENTION

Figure 1A:
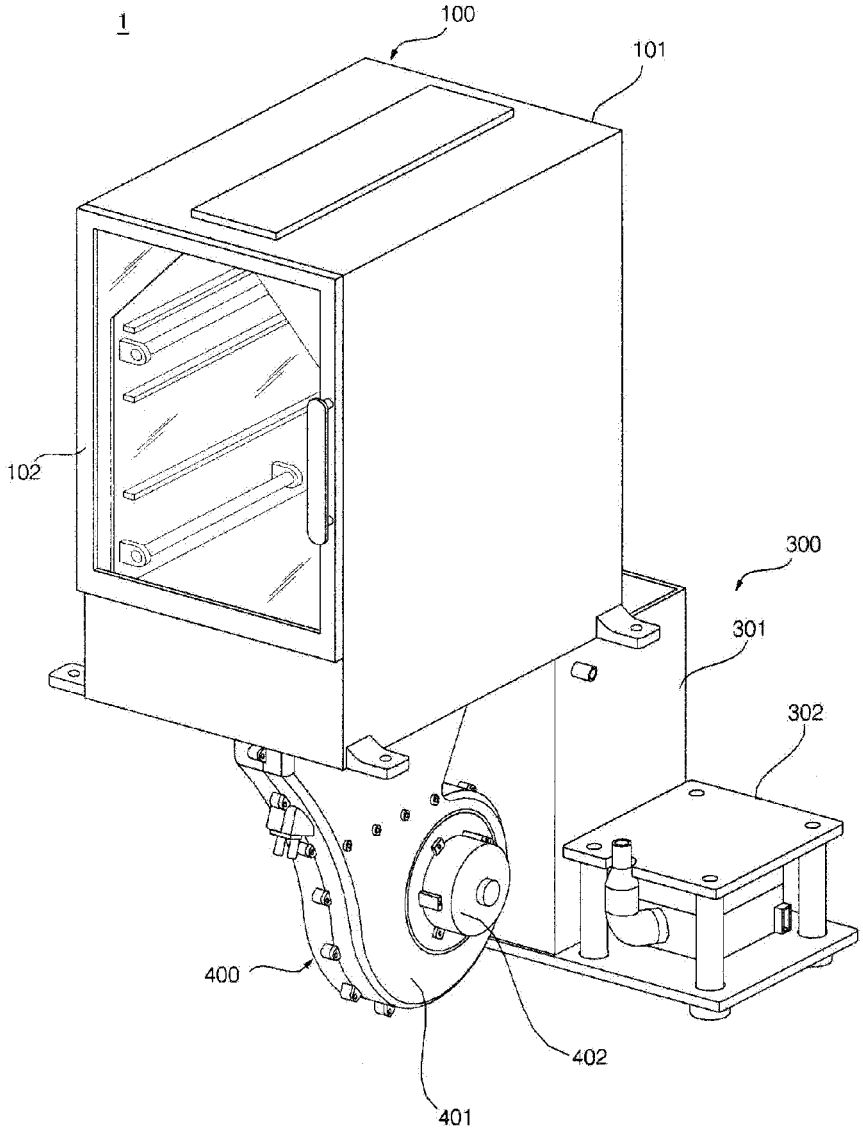
FIG. 1A is a perspective view illustrating a washing machine according to an embodiment of the present invention.

Advantages and characteristics of the present invention and a method of achieving the same will be described more fully with reference to the accompanying drawings, in which embodiments of the present invention are shown. This invention may, however, be embodied in many different forms and should not be construed as being limited to the embodiments set forth herein; rather, these embodiments are provided so that this disclosure will be thorough and complete, and will fully convey the concept of the invention to those skilled in the art. The same reference numerals in different drawings represent the same element, and thus their description will be omitted.

Hereinafter, a composite washing machine (hereinafter, referred to as a washing machine) according to an embodiment of the present invention will be described in detail with reference to the accompanying drawings.

Figure 1B:
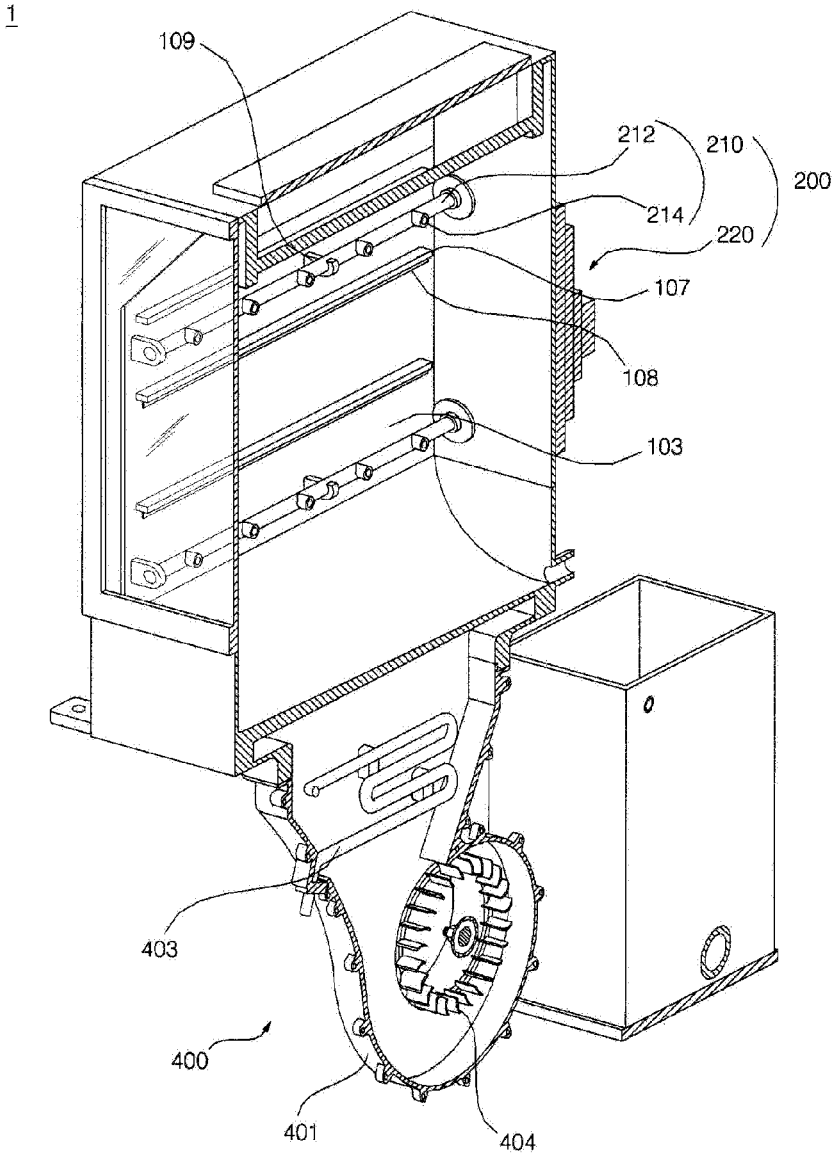
FIGS. 1B and 1C are cross-sectional views illustrating the washing machine illustrated in FIG. 1A.
Figure 1C:
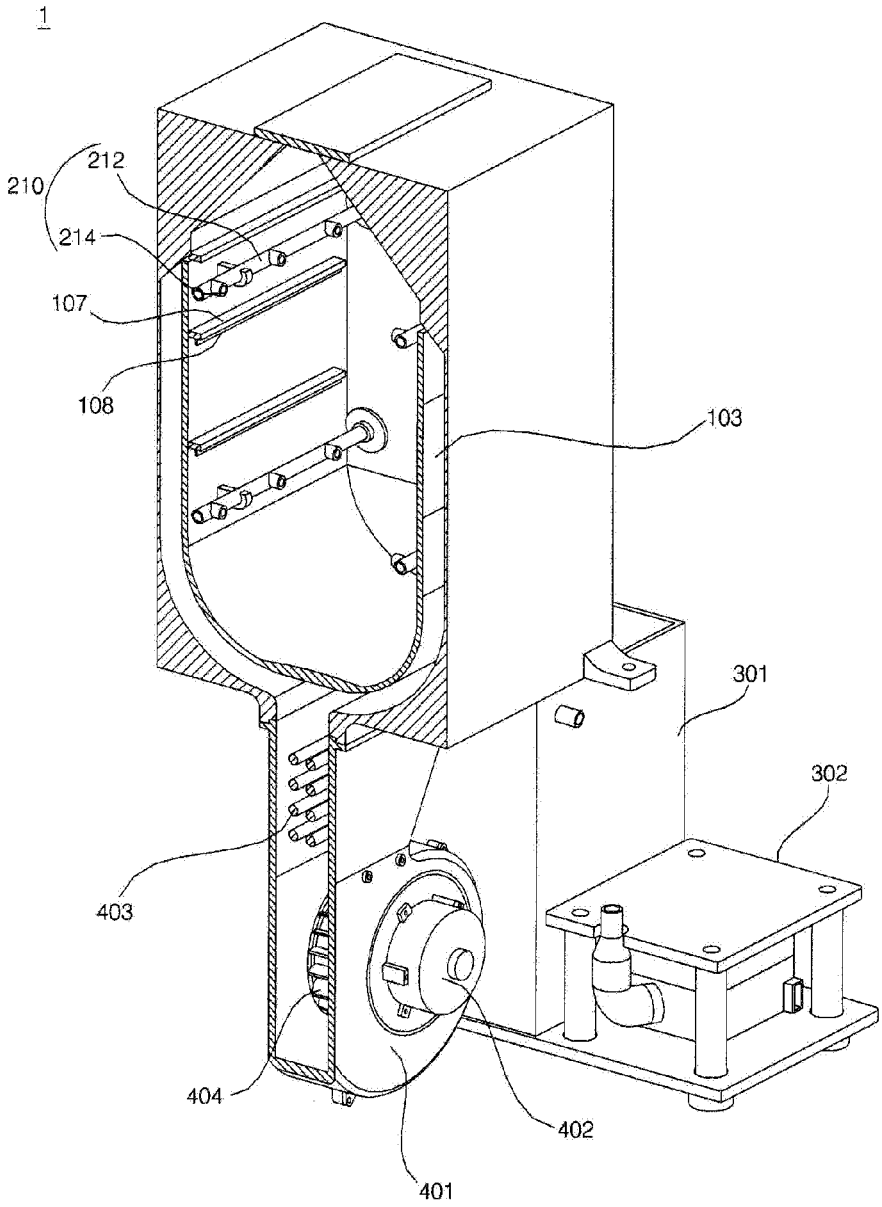
Figure 1D:
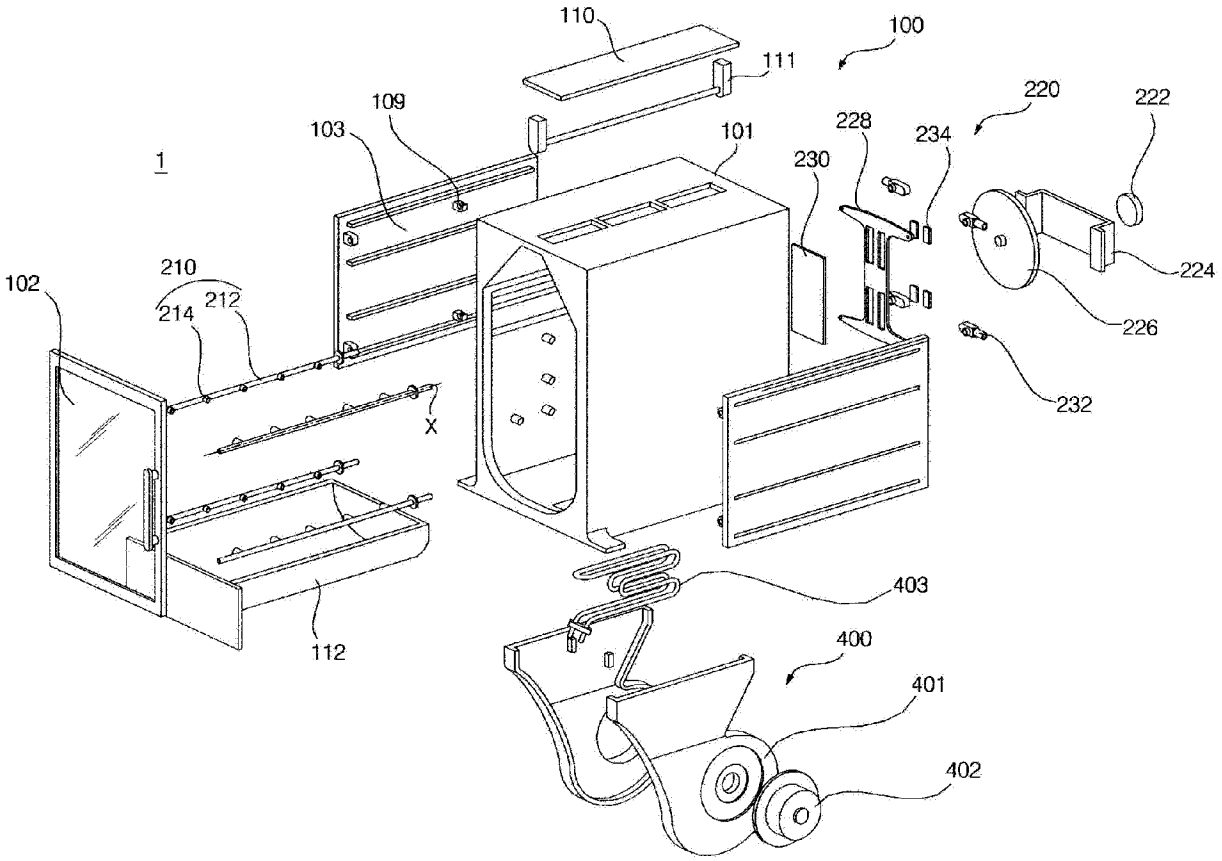
FIG. 1D is an exploded view of the washing machine illustrated in FIG. 1A.

FIG. 1A is a perspective view illustrating a washing machine according to an embodiment of the present invention. FIGS. 1B and 1C are cross-sectional views illustrating the washing machine illustrated in FIG. 1A. FIG. 1D is an exploded view of the washing machine illustrated in FIG. 1A.

Referring to FIGS. 1A to 1D, a washing machine 1 according to an embodiment of the present invention includes an accommodating module 100 including a cabinet 101 in a region of which a door 102 is formed and an accommodating case 103 arranged in the cabinet 101 and having a space in which laundry is accommodated and a plurality of spouting modules 200 arranged in the accommodating case 103 to supply water to the accommodating case 103. The spouting module 200 includes a driving unit 220 and spouting units 210. The driving unit 220 changes a spouting direction of the spouting units 210.

The accommodating module 100 includes the cabinet 101 and the accommodating case 103.

The cabinet 101 forms an external appearance of the accommodating module 100 and the door 102 is provided in a region of the cabinet 101. The door 102 may be opened and closed so that laundry may be accommodated or withdrawn through the door 102. A position and a shape of the door 102 may be optional and are not limited to those illustrated in the drawing. A hanging unit 111 for hanging laundry and a fixing unit 110 for fixing the hanging unit 111 to an upper part of the cabinet 101 may be provided in an internal upper part of the cabinet 101.

The accommodating case 103 for accommodating laundry is arranged in the cabinet 101.

The accommodating case 103 and the cabinet 101 are arranged to be separated from each other by a predetermined distance so that a space is formed between the accommodating case 103 and the cabinet 101. The space may function as an air flow channel through which hot air may flow.

A gutter unit 112 for receiving and gathering water supplied to the accommodating case 103 may be further included in a lower end of the accommodating case 103.

Hot air spouting nozzles 108 for supplying hot air to the accommodating case 103 may be provided on a side surface of the accommodating case 103.

Hanging units 109 are provided on an internal surface of the accommodating case 103 to support the spouting units 210 so that the spouting units 210 may rotate about longitudinal shafts X of the spouting units 210 without straight line displacement.

The spouting module 200 includes the spouting units 210 and the driving unit 220. The spouting units 210 are provided in the accommodating case 103 and the driving unit 220 is provided outside the cabinet 101.

The spouting units 210 include a number of spouting nozzles 214 and a number of nozzle pipes 212 for guiding water to the spouting nozzles 214.

The nozzle pipes 212 are pipe-shaped so that water may be guided through the nozzle pipes 212 to be transmitted to the spouting nozzles 214.

The spouting nozzles 214 are provided in the nozzle pipes 212 and a number of spouting nozzles 214 are arranged in one nozzle pipe 212 in a longitudinal direction of the nozzle pipe 212 to be separated from each other by a predetermined distance. Water guided by the nozzle pipes 212 may be spouted to the accommodating case 103 through the spouting nozzles 214.

Preferably, at least one spouting unit 210 is provided in the accommodating case 103. More preferably, the spouting units 210 arranged in the accommodating case 103 are arranged on both side internal surfaces of the accommodating case 103 to be symmetrical with each other in a horizontal direction. In addition, more preferably, the spouting units 210 arranged on one side surface may be arranged in a number of rows. In addition, more preferably, the spouting units 210 arranged on one side surface may be arranged up and down to be separated from each other by the same distance.

The driving unit 220 is provided outside the cabinet 101 to provide power that may be changed by the spouting units 210. The driving unit 220 includes a driving motor 222, first to third power transmitting units 226, 228, and 232, and first and second fixing units 224 and 230.

A duct module 400 is provided under the cabinet 101. The duct module 400 includes a casing 401, a driving unit 402, a heater unit 403, and a wing unit 404.

A water supply and drainage module 300 is provided under a rear surface of the cabinet 101. The water supply and drainage module 300 includes a water storage unit 301, a pump 302, a water supply pipe 303, a drainage pipe 304, and a branch unit 305.

Figure 2A:
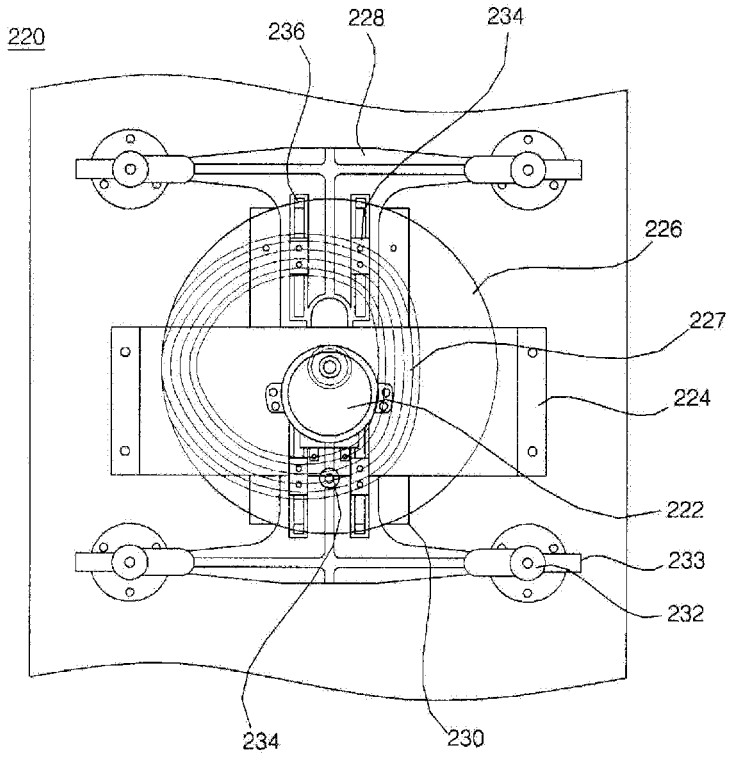
FIGS. 2A and 2B are views illustrating a driving unit of a spouting module according to an embodiment of the present invention.
Figure 2B:
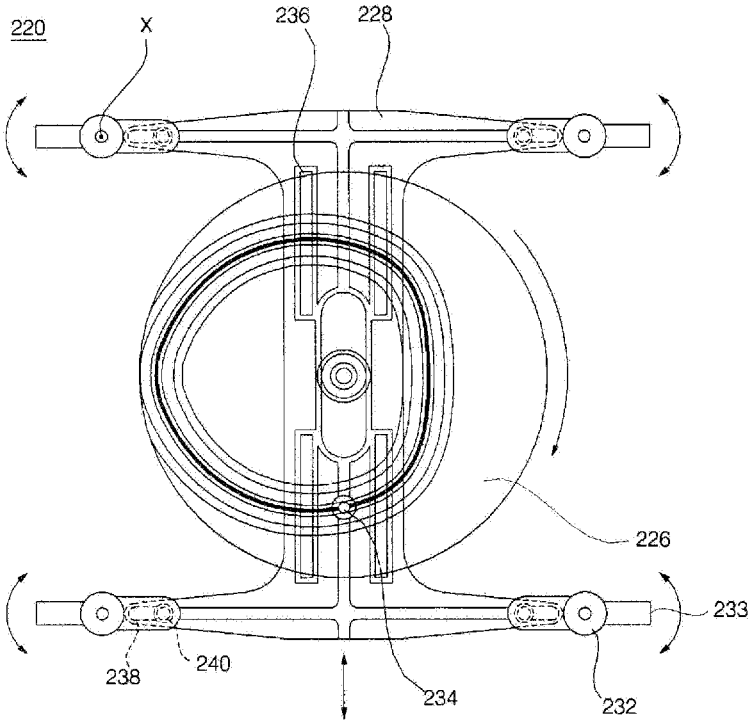

FIGS. 2A and 2B are views illustrating the driving unit 220 of the spouting module 200 according to an embodiment of the present invention.

The driving unit 220 may include the driving motor 222, the first to third power transmitting units 226, 228, and 232 for transmitting a motion of the driving motor 222, and the first and second fixing units 224 and 230.

The first fixing unit 224 fixes the driving motor 222 to the cabinet 101.

The second fixing unit 230 connects the second power transmitting unit 228 and the cabinet 101 and fixes the second power transmitting unit 228 so that the second power transmitting unit 228 may be displaced in at least one direction. In addition, a first guide protruding unit 234 that may be inserted into first guide grooves 236 provided in the second power transmitting unit 228 is provided.

The driving motor 222 is fixedly arranged in a position of the cabinet 101 by the first fixing unit 224 to generate a torque.

The torque generated by the driving motor 222 is transmitted to the spouting units 210 by the first to third power transmitting units 226, 228, and 232. On the other hand, the number of power transmitting units for transmitting the torque generated by the driving motor 222 may be optional, a shape and a power transmitting mechanism of the power transmitting units may be optional, and the number, the shape, and the power transmitting mechanism are not limited to those illustrated in the drawing.

The first power transmitting unit 226 is formed of a cam connected to the driving motor 222 and having a profile with a central shaft separated from a driving shaft of the driving motor 222.

The second power transmitting unit 228 is arranged to overlap an area of the first power transmitting unit 226. The second power transmitting unit 228 includes at least one follower 234 arranged in a central region of a horizontal direction, the first guide grooves 236 arranged in the central region of the horizontal direction and formed to be extended in a vertical direction, and second guide grooves 238 arranged in upper and lower ends and formed to be extended in a horizontal direction.

The follower 234 is connected to the profile of the first power transmitting unit 226. The follower 234 is connected to the profile of the first power transmitting unit 226 so that the follower 234 may be displaced in accordance with the profile of the first power transmitting unit 226. Therefore, the first power transmitting unit 226 rotates so that the follower 234 is displaced while reciprocating in the vertical direction. The follower 234 is displaced while reciprocating in the vertical direction so that the second power transmitting unit 228 may perform a reciprocating motion in the vertical direction.

On the other hand, the second power transmitting unit 228 includes the first guide grooves 236 for the second power transmitting unit 228 to be displaced in the vertical direction without deviating from side to side and the first guide protruding unit 234 may be inserted into the first guide grooves 236. The first guide grooves 236 may be formed to be extended in the vertical direction to be guided by the first guide protruding unit 234. The second power transmitting unit 228 may not be displaced in a side direction but may move in the vertical direction by the first guide protruding unit 234 provided in the second fixing unit 230 and the first guide grooves 236 provided in the second power transmitting unit 228. On the other hand, the first guide grooves 236 may be formed to be symmetrical with each other in the horizontal direction as illustrated in the drawing and is not limited to the above.

The second guide grooves 238 are arranged in the upper and lower ends of the second power transmitting unit 228, are formed to be extended in the horizontal direction, and are connected to the third power transmitting units 232.

The third power transmitting units 232 are combined with ends of the respective spouting units 210 to connect the respective spouting units 210 and the second power transmitting unit 228. The third power transmitting units 232 are combined with the ends of the spouting units 210 so that the third power transmitting units 232 are arranged to be rotatable about longitudinal shafts of the spouting units 210 together with the spouting units 210.

The third power transmitting units 232 include second guide protruding units 240 and the second guide protruding units 240 may be inserted into the second guide grooves 238 provided in the second power transmitting unit 228.

Since the spouting units 210 and the third power transmitting units 232 combined with the spouting units 210 are hung to be rotatable about the longitudinal shafts of the spouting units 210 without straight line displacement, the second power transmitting unit 228 performs a reciprocating vertical motion so that the third power transmitting units 232 may perform reciprocating rotational motions with predetermined central angles about the shafts of the spouting units 210. Furthermore, the spouting units 210 combined with the third power transmitting units 232 may perform reciprocating rotational motions like the third power transmitting units 232.

The spouting module 200 includes the driving unit 220 and the spouting units 210 perform the reciprocating rotational motions with the predetermined central angles by the driving unit 220 so that water may be evenly spouted.

Preferably, the driving motor 222, the first power transmitting unit 226, and the second power transmitting unit 228 may be provided, the second power transmitting unit 228 may be connected to the respective third power transmitting units 232, and the respective third power transmitting units 232 may be connected to the spouting units 210. Since the operations of all of the spouting units 210 may be controlled by the driving motor 222, water may be evenly spouted using the simple spouting module 200.

Figure 3A:
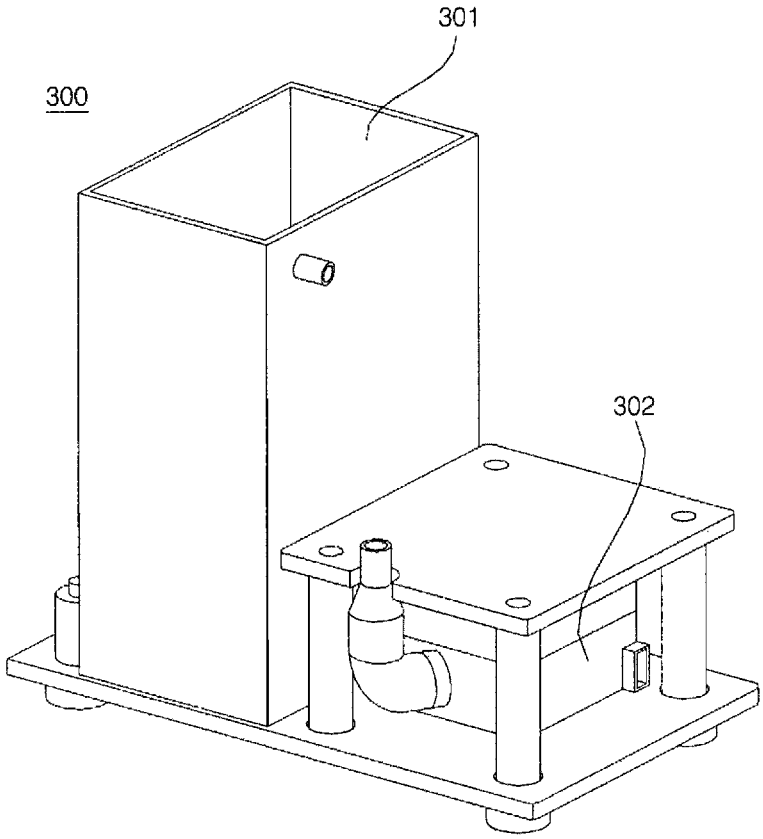
FIG. 3A is a perspective view illustrating a water supply and drainage module according to an embodiment of the present invention.
Figure 3B:
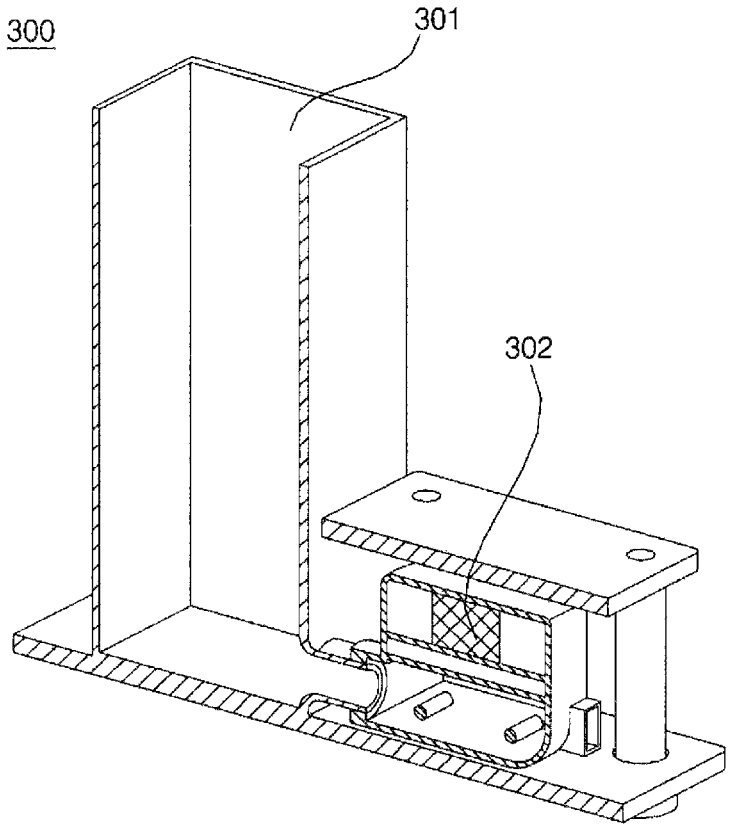
FIG. 3B is a cross-sectional view of the water supply and drainage module illustrated in FIG. 3A.
Figure 4:
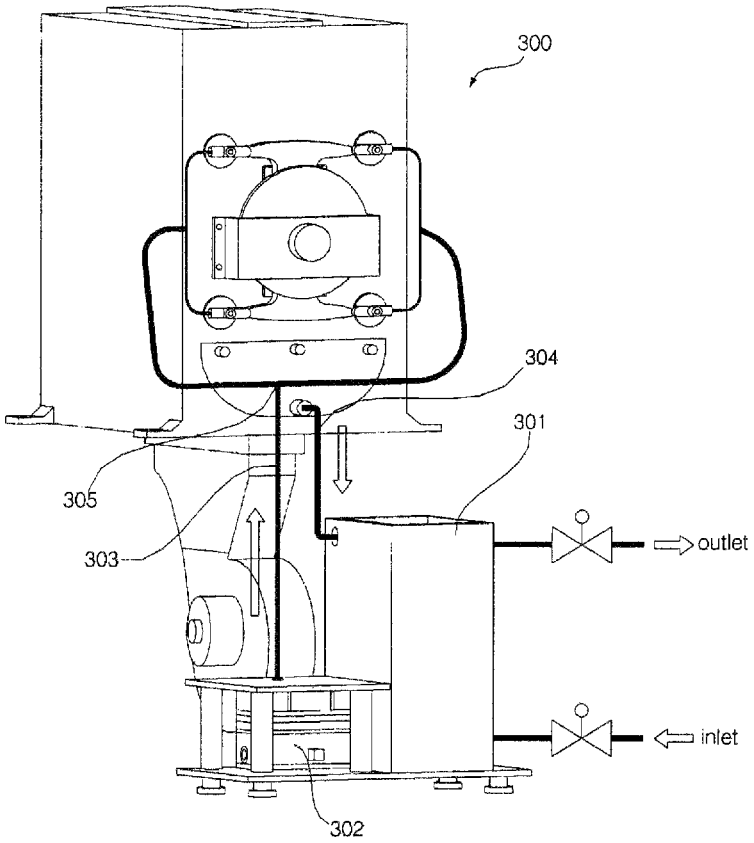
FIG. 4 is a block diagram illustrating a water supply and drainage structure according to an embodiment of the present invention.

FIG. 3A is a perspective view illustrating a water supply and drainage module according to an embodiment of the present invention. FIG. 3B is a cross-sectional view of the water supply and drainage module illustrated in FIG. 3A. FIG. 4 is a block diagram illustrating a water supply and drainage structure according to an embodiment of the present invention. Referring to FIGS. 3A, 3B, and 4, the water supply and drainage module 300 may include the pump 302, the water storage unit 301, the water supply pipe 303, and the drainage pipe 304.

The pump 302 is connected to the spouting module 200 through the water supply pipe 303. The pump 302 pumps water supplied from the outside to the spouting module 200 so that the water is spouted to the accommodating case 103 through the spouting nozzles 214 provided in the accommodating case 103.

The water storage unit 301 accommodates water supplied from the outside or water drained from the cabinet 101 through the drainage pipe 304. The water supplied from the outside is accommodated in the water storage unit 301 and is guided by the pump 302 to the spouting module 200 through the water supply pipe 303 to be spouted through the spouting nozzles 214.

The water storage unit 301 is connected to the cabinet 101 through the drainage pipe 304. Water left in the accommodating case 103 after washing, rinsing, and dewatering processes is accommodated in the water storage unit 301 through the drainage pipe 304. The water stored in the water storage unit 301 may be discharged to the outside or may be guided by the pump 303 to the spouting module 200 through the water supply pipe 303.

The water supply pipe 303 may be connected between the pump 302 and the spouting module 200 to guide the water supplied from the pump 302 to the spouting module 200.

The drainage pipe 303 may be connected between the cabinet 101 and the water storage unit 301 to drain the water left in the cabinet 101 after the washing and rinsing processes from the cabinet 101. Preferably, the drainage pipe 303 may be connected to a bottom of the cabinet 101 so that amounts of water and contaminated water may be reduced and the cabinet 101 and the accommodating case 103 may be maintained clean after drainage.

Preferably, the water supply pipe 302 includes at least one branch unit 305 in order to distribute water to the spouting units 210 arranged in the respective regions of the accommodating case 103. The water supply pipe 302 includes at least one branch unit 305 so that the water supply pipe 302 may form at least one Y-shaped flow channel having a number of branches.

The water supply pipe 302 includes at least one branch unit 305 and forms at least one Y-shaped flow channel so that the water supplied from the pump 302 to the spouting module 200 may be efficiently distributed to the respective spouting units 210.

Figure 5A:
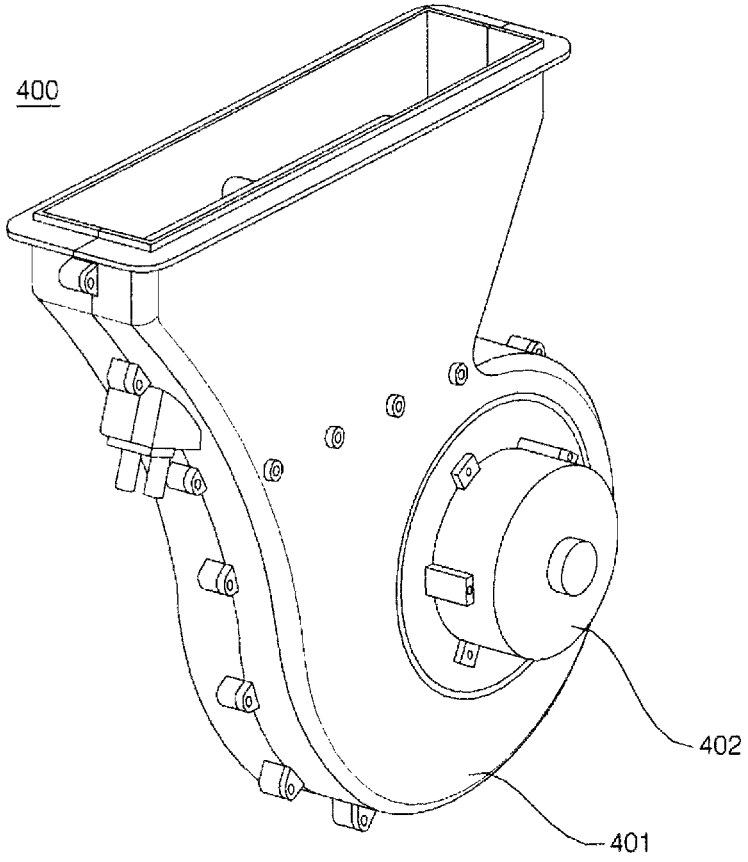
FIG. 5A is a perspective view illustrating a duct module according to an embodiment of the present invention.
Figure 5B:
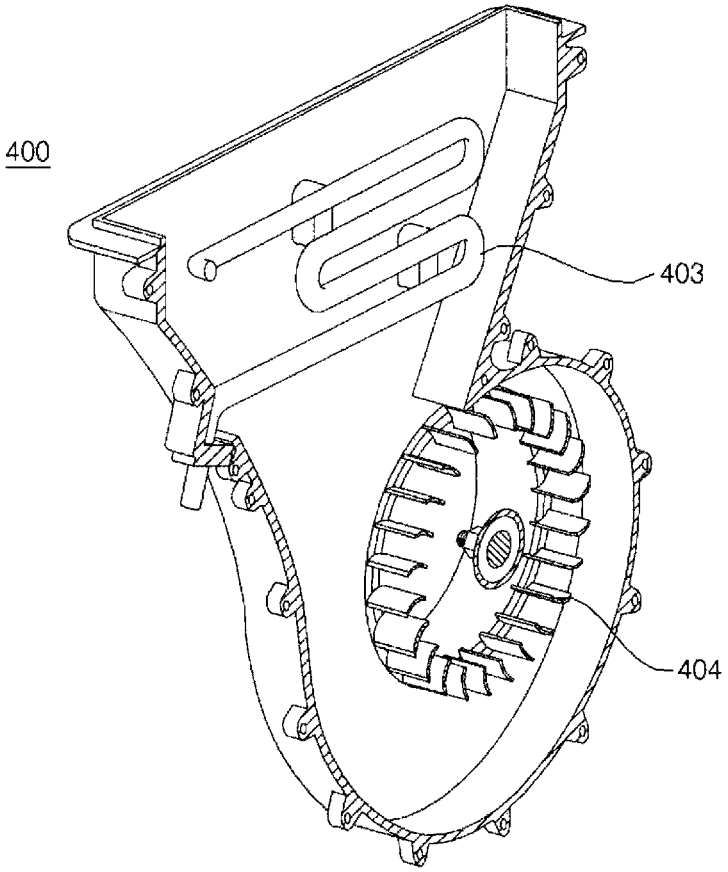
FIG. 5B is a cross-sectional view of the duct module illustrated in FIG. 5A.

FIG. 5A is a perspective view illustrating a duct module according to an embodiment of the present invention. FIG. 5B is a cross-sectional view of the duct module illustrated in FIG. 5A.

Referring to FIGS. 5A and 5B, the duct module 400 according to the embodiment of the present invention includes the casing 401, the driving unit 402, the heater unit 403, and the wing unit 404.

The casing 401 forms an external appearance of the duct module 400. An empty space is formed in the casing 401 so that an air flow channel is formed.

The heater unit 403 heats air in the duct module 400 so that hot air is generated.

The driving unit 402 is provided inside or outside the duct module 400 to generate a torque that may rotate the wing unit 404. The wing unit 404 is provided in the duct module 400 to rotate through the torque generated by the driving unit 402 and to promote flow of the air in the duct module 400.

Therefore, the air in the duct module 400 is heated by the heater unit 403 so that hot air is generated and the hot air is flown to the duct module 400 and the cabinet 101 by the wing unit 404 and is supplied to the accommodating case 103 through the hot air spouting nozzles 108 provided in the accommodating case 103 to dry laundry in the accommodating case 103.

Figure 6:
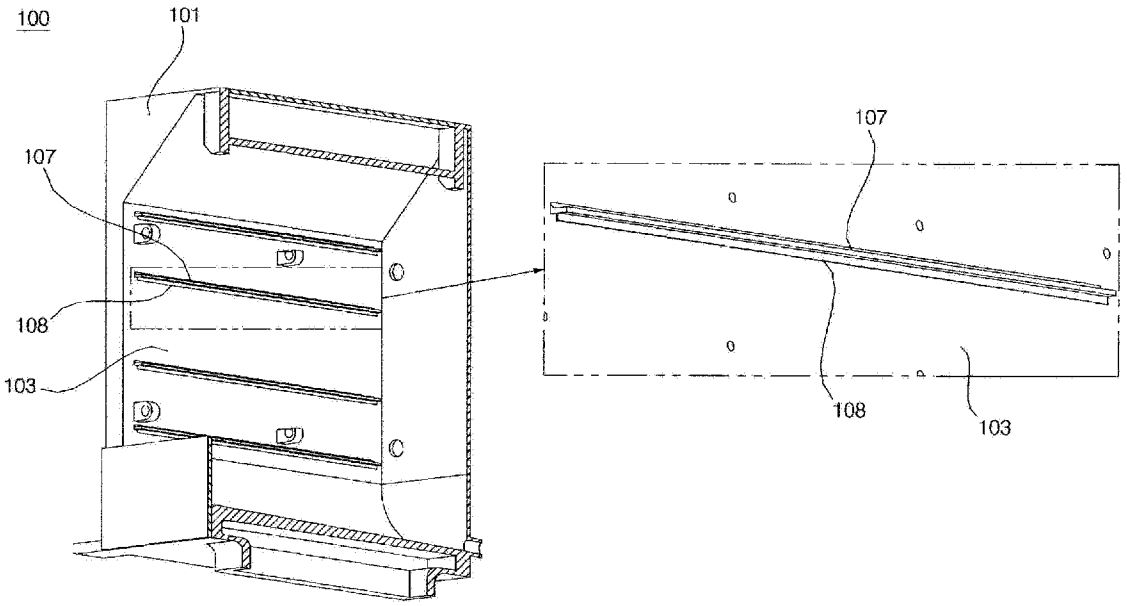
FIG. 6 is a partial cross-sectional view illustrating an internal surface of an accommodating case of a washing machine according to an embodiment of the present invention.

FIG. 6 is a partial cross-sectional view illustrating an internal surface of an accommodating case of a washing machine 1 according to an embodiment of the present invention.

Referring to FIG. 6, the hot air spouting nozzles 108 and the hot air spouting guide units 107 may be provided on an internal surface of the accommodating case 103.

The hot air spouting nozzles 108 may be provided by forming at least one hole on a side surface of the accommodating case 103. The hot air generated by the duct module 400 may pass through the air flow channel between the accommodating case 103 and the cabinet 101 to be spouted to the accommodating case 103 through the hot air spouting nozzles 108.

Preferably, as illustrated in FIG. 6, in the hot air spouting nozzles 108, a number holes extended in a horizontal direction may be arranged to run parallel at predetermined intervals in a vertical direction and the hot air spouting nozzles 108 are not limited to the above.

The hot air spouting guide units 107 are adjacent to the hot air spouting nozzles 108 in the accommodating case 103 so that the hot air spouted to the accommodating case 103 may have a predetermined direction. Preferably, the hot air spouting guide units 107 may be plates extended in a horizontal direction to run parallel with the hot air spouting nozzles 108 so that the hot air spouted through the hot air spouting nozzles 108 may be guided in a predetermined direction, forming predetermined angles with the internal surface of the accommodating case 103, and having predetermined areas and are not limited to the above. In addition, preferably, the hot air spouting guide units 107 may be arranged to form top surfaces of the hot air spouting nozzles 108 and are not limited to the above.

Since the hot air spouting nozzles 108 and the hot air spouting guide units 107 are provided on a side surface of the accommodating case 103 so that the hot air spouted through the hot air spouting nozzles 108 may be guided in a predetermined direction, laundry may be easily dried.

Figure 7A:
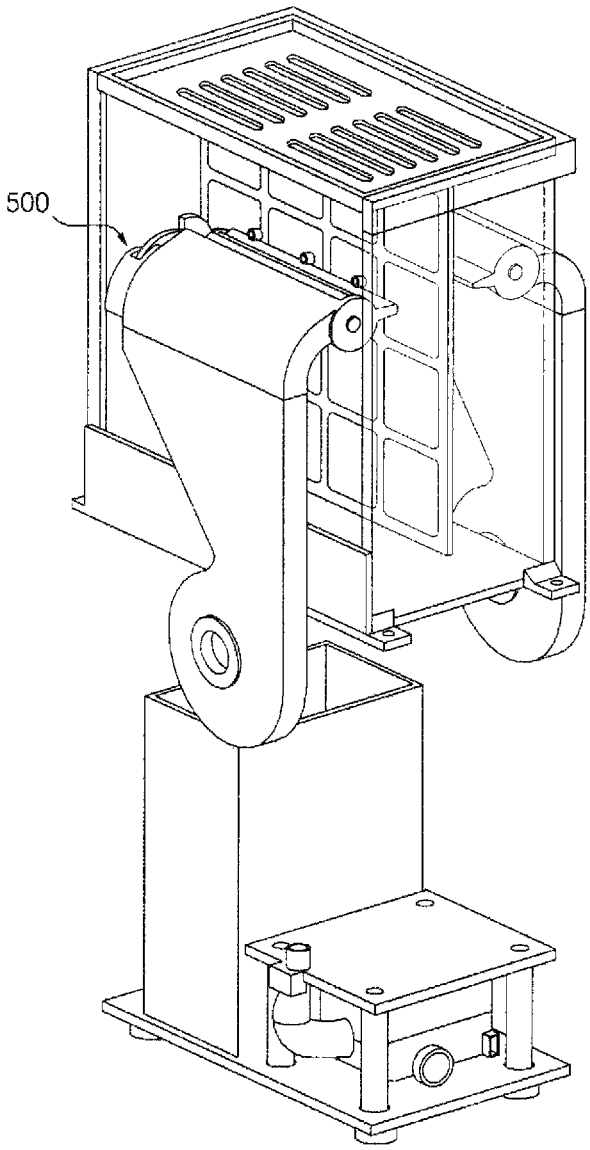
FIG. 7A is a partial perspective view of a washing machine including a spouting module according to an embodiment of the present invention.
Figure 7B:
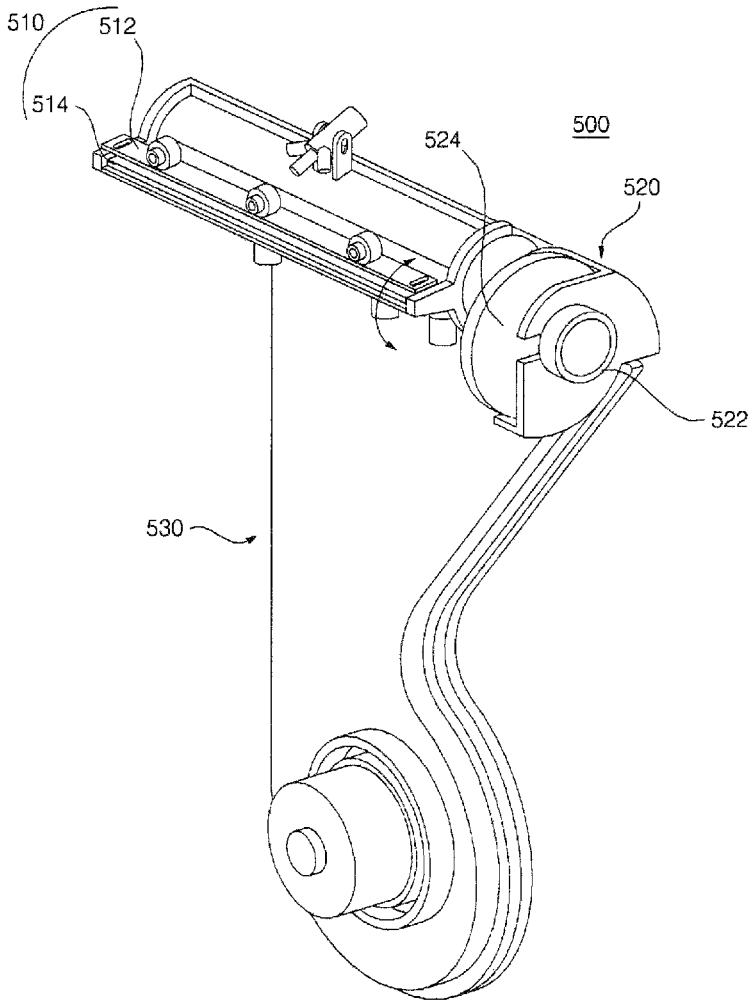
FIG. 7B is an enlarged view of the spouting module illustrated in FIG. 7A.

FIG. 7A is a partial perspective view of a washing machine including a spouting module according to an embodiment of the present invention. FIG. 7B is an enlarged view of the spouting module illustrated in FIG. 7A.

Referring to FIGS. 7A and 7B, a spouting module 500 may include a spouting unit 510, a driving unit 520, and a duct unit 530.

Preferably, the spouting modules 500 may be arranged on both side surfaces of the accommodating case 103. Preferably, the spouting units 510 may be arranged to be symmetrical with each other in a horizontal direction.

The spouting unit 510 includes a first spouting nozzle 512 and a second spouting nozzle 513 and the first and second spouting nozzles 512 and 514 are integrated with each other to form the spouting unit 510.

The first spouting nozzle 512 as a water supply spouting nozzle may spout water supplied from the water supply and drainage module 300 to the accommodating case 103.

The second spouting nozzle 514 as a hot air spouting nozzle may spout hot air generated by the duct unit 530 to the accommodating case 103.

The spouting module 500 includes the duct unit 530 and the duct unit 530 generates hot air spouted through the second spouting nozzle 514.

The spouting module 500 includes the driving unit 520 and the driving unit 520 may include a driving motor 522 and a power transmitting unit 524. A torque generated by the driving motor 522 is transmitted to the spouting unit 510 through the power transmitting unit 524. The spouting unit 510 may perform a reciprocating rotational motion with a predetermined central angle about a shaft of the spouting unit 510 through the torque of the driving motor 522 and a motion direction conversion of the power transmitting unit 522.

The spouting module 500 includes the hot air spouting nozzle 514 and the water supply spouting nozzle 512 and the hot air spouting nozzle 514 are integrated with each other to form the spouting unit 510 so that the water supply spouting nozzle 512 and the hot air spouting nozzle 514 are integrally driven to perform a reciprocating rotational motion with a predetermined central angle about the same shaft.

The hot air spouting nozzle 514 performs the reciprocating rotational motion with the predetermined angle so that hot air may be evenly spouted to laundry so that the laundry may be effectively dried.

Figure 8:
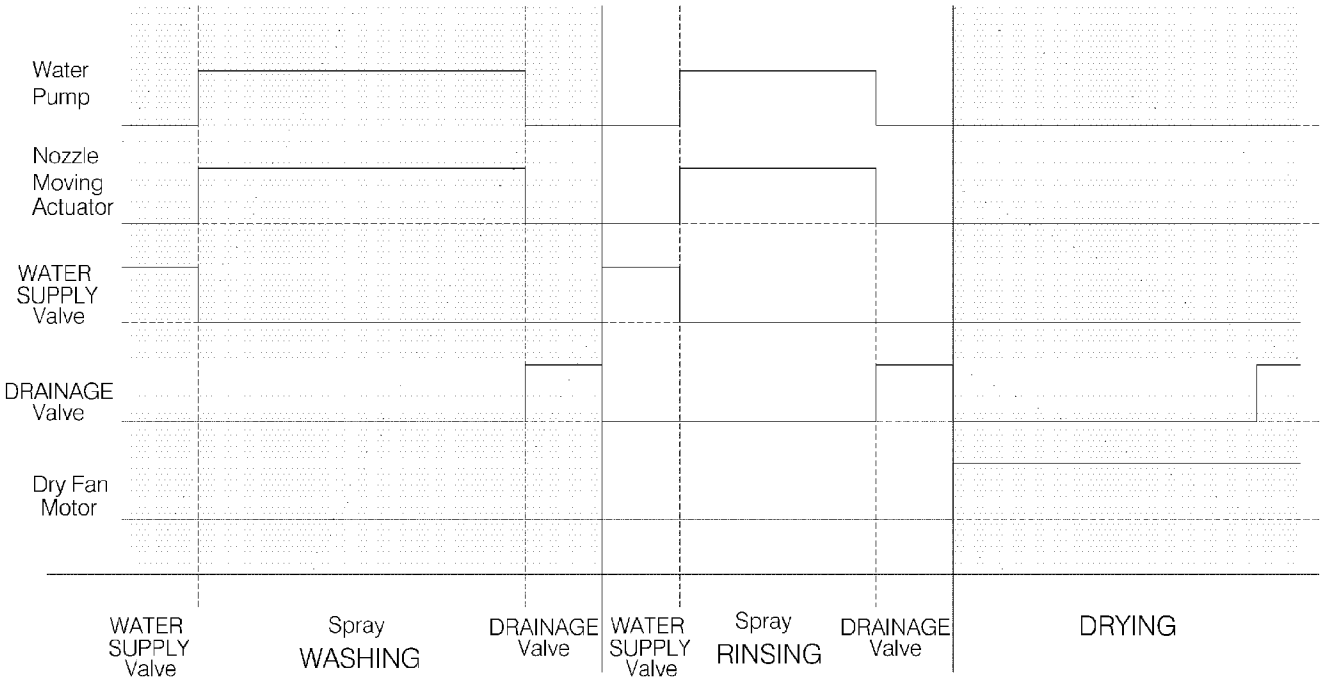
FIG. 8 is a view illustrating an operation of a washing machine according to an embodiment of the present invention.

In addition, the water supply spouting nozzle 512 and the hot air spouting nozzle 514 are integrated with each other to perform the reciprocating rotational motion so that the water supply spouting nozzle 512 and the hot air spouting nozzle 514 may be driven and controlled by a simple driving apparatus, FIG. 8 is a view illustrating an operation of a washing machine according to an embodiment of the present invention.

An operation of the washing machine according to the present invention is divided into a washing operation, a rinsing operation, and a drying operation. The washing operation is divided into a water supply process, a spouting process, and a drainage process. The rinsing operation is divided into a water supply process, a spouting process, and a drainage process.

In the water supply process of the washing operation, a water supply valve is opened so that water is supplied from the outside to be accommodated in the water storage unit 301. The water accommodated in the water storage unit 301 may be mixed with detergent according to an embodiment.

In the spouting process of the washing operation, the pump 302 is operated so that the water accommodated in the water storage unit 301 is guided to the spouting units 210 through the water supply pipe 303 to be spouted to the accommodating case 103 through the spouting nozzles 214. At this time, the driving motor 222 of the driving unit 220 has the spouting units 210 perform the reciprocating rotational motions so that the water is evenly spouted up and down.

The water spouted through the spouting nozzles 214 is drained from the cabinet 101 through the drainage pipe 304, is accommodated in the water storage unit 301, and may be spouted by the pump 302 through the spouting nozzles 214.

In the drainage process of the washing operation, a drainage valve is opened so that water drained from the cabinet 101 through the drainage pipe 304 to be accommodated in the water storage unit 301 is discharged to the outside.

In the water supply process of the rinsing operation, like in the water supply process of the washing operation, the water supply valve is opened so that water is supplied from the outside to be accommodated in the water storage unit 301. The water stored in the water storage unit 301 may be mixed with fabric softener according to an embodiment.

In the spouting process of the rinsing operation, like in the spouting process of the washing operation, the pump 302 is operated so that the water accommodated in the water storage unit 301 is guided to the spouting units 210 through the water supply pipe 303 to be spouted to the accommodating case 103 through the spouting nozzles 214 and the driving motor 222 of the driving unit 220 has the spouting units 210 perform the reciprocating rotational motions so that the water is evenly spouted up and down. The water spouted through the spouting nozzles 214 is drained from the cabinet 101 through the drainage pipe 304 to be accommodated in the water storage unit 310 and may be spouted by the pump 302 through the spouting nozzles 214.

In the drainage process of the rinsing operation, like in the drainage process of the washing operation, the drainage valve is opened so that water drained from the cabinet 101 through the drainage pipe 304 to be accommodated in the water storage unit 301 is discharged to the outside.

In the drying operation, the heater unit 403 is operated so that air in the duct module 400 is heated so that hot air is generated and the generated hot air is flown to the duct module 400 and the cabinet 101 by the rotation of the wing unit 404 to be supplied to the accommodating case 103 through the hot air spouting nozzles 108.

In the drying operation, water that falls from laundry and condensate water generated in the accommodating case 103 are drained through the drainage pipe 304 to be accommodated in the water storage unit 301. In the latter half of the drying operation, the drainage valve is opened so that the water accommodated in the water storage unit 301 is discharged to the outside.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

The invention claimed is:

1. A washing machine, comprising:

a cabinet forming an external appearance:

an accommodating module arranged in the cabinet and including an accommodating case in which a space for accommodating laundry is formed;

a plurality of spouting units formed in a horizontal direction and arranged in the accommodating case to spout water, wherein the plurality of spouting units are arranged on both side surfaces of the accommodating case to be symmetrical with each other;

a driving motor for generating a torque;

a first power transmitting unit formed of a cam connected to the driving motor;

a second power transmitting unit having a follower connected to the first power transmitting to performs a reciprocating motion in the vertical direction; and a plurality of third power transmitting units connected to ends of the respective spouting units and the second power transmitting unit such that the respective spouting units perform reciprocating rotational motions with predetermined central angles about the shafts of the spouting units.

2. The washing machine of claim 1, wherein the spouting units comprise:

nozzle pipes through which water is guided; and a plurality of spouting nozzles arranged in a longitudinal direction of the nozzle pipes.

3. The washing machine of claim 1, further comprising hanging units provided on an internal surface of the accommodating case to support the spouting units to be rotatable.

4. The washing machine of claim 1, further comprising:

a drainage pipe connected to the cabinet so that water is drained from the cabinet; and a water storage unit connected to the drainage pipe to accommodate the water drained through the drainage pipe.

5. The washing machine of claim 1, further comprising hot air spouting nozzles arranged in the accommodating case to supply hot air to the accommodating case.

6. The washing machine of claim 5, wherein, in the plurality of hot air spouting nozzles, a number of holes extended in a horizontal direction are arranged to run parallel with each other at predetermined intervals in a vertical direction.

7. The washing machine of claim 5, wherein hot air spouting guide units are provided to be adjacent to the hot air spouting nozzles in the accommodating case so that hot air spouted by the hot air spouting nozzles may have a predetermined direction.

8. The washing machine of claim 7, wherein the hot air spouting nozzles are holes extended in a horizontal direction, and wherein the hot air spouting guide units are plates extended to run parallel with the hot air spouting nozzles, forming predetermined angles with an internal surface of the accommodating case in a vertical direction, and having predetermined areas and are provided on the hot air spouting nozzles.

9. The washing machine of claim 1, further comprising a water supply pipe for guiding water to the spouting units, wherein the water supply pipe comprises at least one branch unit that forms a Y-shaped flow channel.

10. The washing machine of claim 1, wherein the spouting unit comprises:

a first spouting nozzle for spouting water to the accommodating case; and a second spouting nozzle for supplying hot air to the accommodating case.

* * * * *